US005773762A

United States Patent [19]

Orr, Jr. et al.

[11] Patent Number: 5,773,762

[45] Date of Patent: Jun. 30, 1998

[54] CABLE WITH VARYING CELL ARRANGEMENTS

[75] Inventors: Lawrence William Orr, Jr., Simpsonville; Sharon Ledbetter Adams, Greenville; Kathryne R. Hammett, Piedmont, all of S.C.

[73] Assignee: Woven Electronics Corporation, Mauldin, S.C.

[21] Appl. No.: 628,035

[22] Filed: Apr. 4, 1996

[51] Int. Cl.[6] ..... H01B 7/04

[52] U.S. Cl. ..... 174/117 M; 174/72 A

[58] Field of Search ..... 174/117 R, 117 F, 174/117 M, 72 R, 72 A

[56] References Cited

U.S. PATENT DOCUMENTS

| | | | |
|---|---|---|---|
| 3,627,903 | 12/1971 | Plummer | 174/72 A |
| 4,095,042 | 6/1978 | Ross | 174/36 |
| 4,229,615 | 10/1980 | Orr, Jr. et al. | 174/117 M |
| 4,460,803 | 7/1984 | Piper | 174/36 |
| 4,504,696 | 3/1985 | Piper | 174/32 X |
| 4,559,411 | 12/1985 | Piper | 174/117 M |
| 4,746,769 | 5/1988 | Piper | 174/117 M |
| 4,804,806 | 2/1989 | Orr, Jr. et al. | 174/117 M |
| 4,808,771 | 2/1989 | Orr, Jr. | 174/117 M |
| 5,385,765 | 1/1995 | Springer et al. | 428/36.1 X |

*Primary Examiner*—Kristine L. Kincaid
*Assistant Examiner*—Chali N. Nguyen
*Attorney, Agent, or Firm*—Henry S. Jaudon; Cort Flint

[57] ABSTRACT

A woven wire harness assembly for use in restricted areas of varying sizes. The harness assembly includes a fabricate cable carrying a plurality of insulated conductor groups. The cable is formed of warp yarns woven with a weft yarn to form a trunk portion and a tube portion. Both the trunk portion and the tube portion terminate with a breakout area. The trunk portion includes a plurality of cells while the tube portion has only a single cell. The plurality of insulated conductors extend continuously along the length of harness assembly through the individual cells to finally consolidate and extend through the single cell. The cable is woven at a density which provides approximately 90% cover providing mechanical and thermal insulation for the insulated conductors.

24 Claims, 8 Drawing Sheets

CABLE WITH VARYING CELL ARRANGEMENTS

BACKGROUND OF THE INVENTION

This invention relates to U.S. Pat. Nos. 4,746,769 and 5,373,103, both assigned to Woven Electronics Corp., the assignee of the instant application.

In many applications of woven multi-conductor cable assemblies, such as in airplane fuselages, guided missile and tele-communication panels, the placement area available for routing is minimal and of changing configuration. There is also a need to protect the shielded conductors from heat buildup during operation of any one of these systems, and a need to provide numerable connecting tabs along the length of the cable assembly.

Flat woven cable assemblies are known. Examples of certain of these assemblies are disclosed in U.S. Pat. Nos. 3,627,903; 4,095,042; 4,229,615; and 4,746,769. The first of these patents, U.S. Pat. No. 3,627,903, discloses a plurality of insulated conductors held in position by a loosely woven fabric of warp and weft yarns 18 and 17. The conductors are spaced by the warp. FIG. 3 shows a pair of cables which are interconnected. U.S. Pat. No. 4,229,615 discloses a multi-conductor cable woven to have flat sections A and circular sections B. The insulated conductors extend freely through the round section and are controlled by the warp and weft in the flat sections. U.S. Pat. No. 4,095,042 discloses a shielded cable in which the conductor wires are interwoven with a plurality of metallic fiber strands. A woven cover is formed which isolates the conductor wires from electromagnetic interference. U.S. Pat. No. 4,746,769 discloses a multi-layer high density woven cable comprising ground conductor warp wires and signal conductor warp wires. The cable includes spaced breakout areas and cut line areas. In the cut areas, the warp, i.e. signal and ground conductors, are bound in a weave. The signal conductors in the break out areas are broken out to appear on opposite sides of the grown conductors. The remainder of the cable is simply double woven unit.

The objects of this invention which are next outlined are not addressed by the referred to patents.

A primary object of this invention is to provide a flexible woven cable assembly of varying sizes along its length.

Another object of this invention is to provide a flexible woven cable assembly having a heat resistant insulating outer shell.

Another object of this invention is to provide an elongated woven cable assembly provided with a plurality of securing elements along its length.

Another object of the invention is to provide a woven cable assembly in which the woven carrier is woven to a density sufficient to provide 100% cover for the conductors carried thereby.

Another object of the invention is to provide a woven harness assembly in which the conductors are protected from abrasion.

Another object of the invention is the provision of a woven cable assembly designed to be enlarged by uniting with a mirror cable assembly.

Another object of the invention is the provision of a woven harness assembly having varying numbers of conductor carrying cells arranged along its length.

Another object of the invention is the provision of a woven harness assembly having insulating properties which insulate the conductor wires which allows the assembly to be used in conditions having extreme variations of temperature.

SUMMARY OF THE INVENTION

The above objectives are accomplished according to the present invention by the provision of a woven wire harness assembly constructed for use in confined areas of varying size. The assembly comprises first and second woven cables each having at least one trunk and at least one tube portion. The trunk portions are formed to have a plurality of cells arranged in decreasing order along their length. Each of the tube portions comprise a single cell which is connected at one end with one end of a trunk portion in a manner which causes the cells of the trunk portion to merge with the single cell of the tube portion. A plurality of insulated conductors are arranged in and extend along the length of the cable to be protected from heat and abrasion by passing through each of the cells. A selvage is woven with each of the trunk portions to extend along one edge thereof. The first and second cables are stacked one upon the other with the selvage of the first cable being arranged over the selvage of the second cable. The first and second cables are interconnected along their length at the selvages to form the woven harness assembly.

A break out is formed at the opposite ends of each of the cables. The break outs are formed with tabs which are used to connect the harness assembly with the support structure. The break outs each have an opening which allows the opposed ends of the conductors to extend beyond the cables so that they may be connected with connectors.

The insulated conductors may be arranged so that a plurality of conductors pass through each cell or so that only a single conductor passes through certain cells.

Binder warps may be inserted through certain cells. The binder warps act to stabilize the position of the conductors within the cells.

A woven cable assembly is formed to have a density which provides cover for the conductor wires of approximately 90%. The cable includes a first plurality of warp yarns woven with a weft yarn to form a trunk portion and a tube portion. The trunk portion is formed with a plurality of cells while the tube portion is formed with a single cell. A break out is formed at opposite ends of the cable. A plurality of insulated conductors each having exposed opposed ends are arranged to extend continuously along the length of the cable. The conductors extend through the cells with their exposed ends extending outwardly from the break out areas.

The trunk portion is formed to have at least two cells and the second section is formed with at least four cells. The tube portion merges with a first end of the first section of the trunk portion forming a first break point. The break point is where two cells of the first section merge with the single cell of the tube portion. Another break point is where the two cells of the first section of the trunk portion merge with the four cells of the second section of the trunk portion.

The conductors extend within each of the cells along the length of the cable. Stuffer warps are provided and extend through only the cell of the tube portion along with the conductors. The stuffer warps act to pack the conductors in a stable stationary position within the cell of the tube portion.

The cable assembly includes a second plurality of warp yarns. These warp yarns weave with the weft yarn to form a selvage along at least one side of the cable. The selvage is formed integral only with the trunk portion. It does extend along a portion of the tube portion, however it is not formed integral therewith. The portion of the selvage along the tube portion forms an elongated tab.

Second and third tabs are formed at opposite ends of the cable assembly. These tabs are connected with and extend from the breakouts.

Binder warp yarns are interspersed with the first warp yarns. The binder warp yarns weave with the weft yarn in a manner to form the plurality of cells within the trunk portion.

The warp yarns are formed of synthetic material, preferably thermoplastic multi-filament yarn of VECTRAN which is a liquid crystal polymer. The weft yarn is also preferably formed of multi-filament yarns of Vectran. Vectran, which is commercially available only from Hoechst Celanese Vectra, possesses good insulating qualities which allow the cable assembly when woven of sufficiently density to achieve 100% cover which provides a high degree of protection for the insulated conductors.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
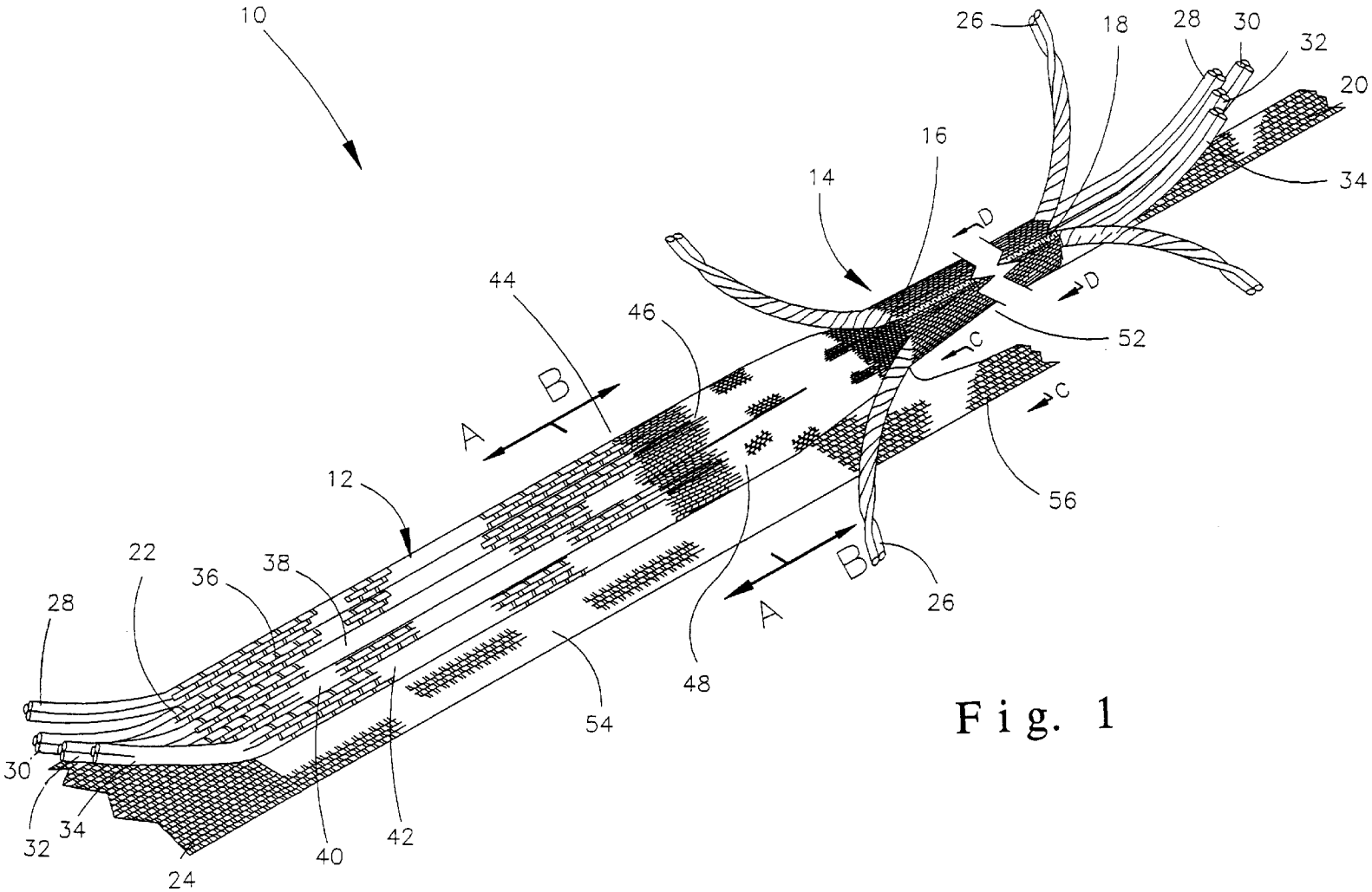
FIG. 1 is a perspective view of the cable assembly of the invention.

The invention will now be described in detail while referring to the drawings. FIG. 1 shows a primary embodiment of the woven wire harness assembly of the invention. Harness or cable assembly 10 includes a substantially flat woven trunk section 12 which merges at a first end with a first end of a substantially tubular woven tube section 14. The merge point is identified as break point 16. The opposite ends of tube 14 is comprised of breakout 18 and tube tab 20. The opposite end of trunk 12 is comprised of break out 22 and trunk tab 24.

Figure 2:
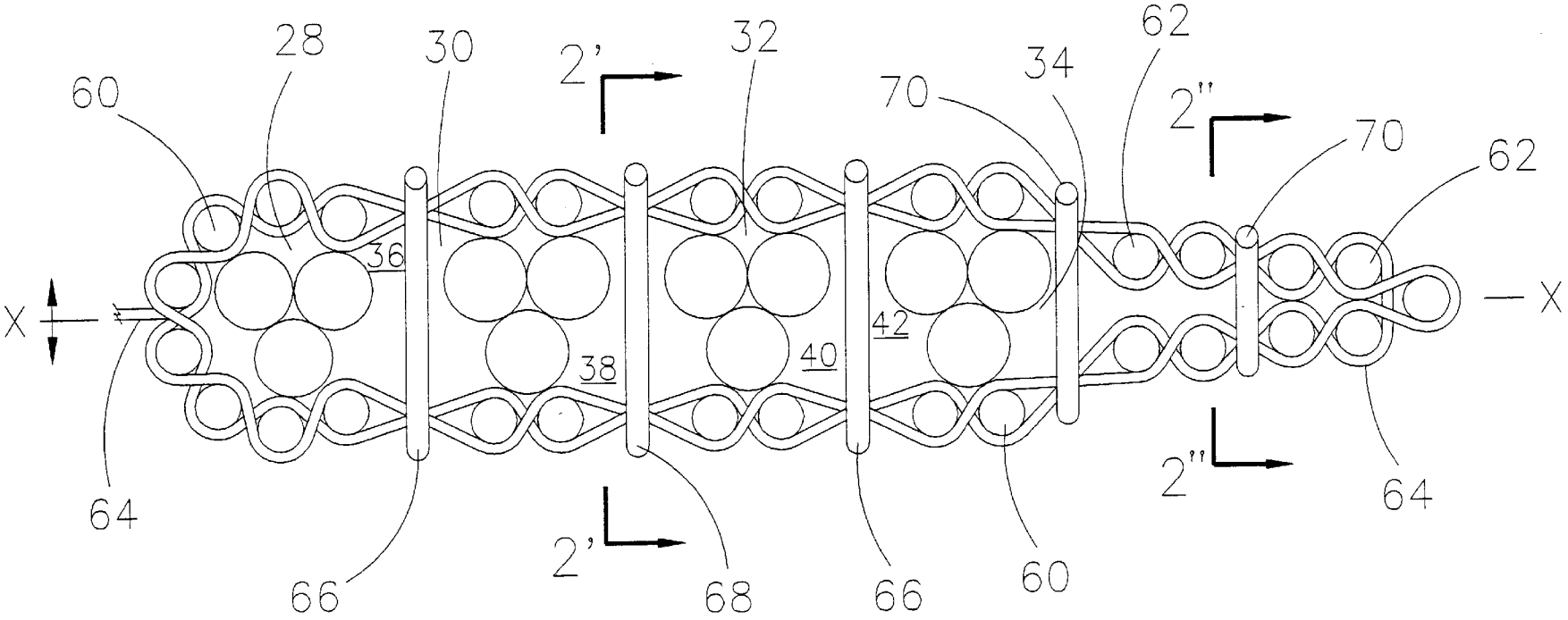
FIG. 2, is a sectional end view taken along line A—A of FIG. 1.
Figure 2A:
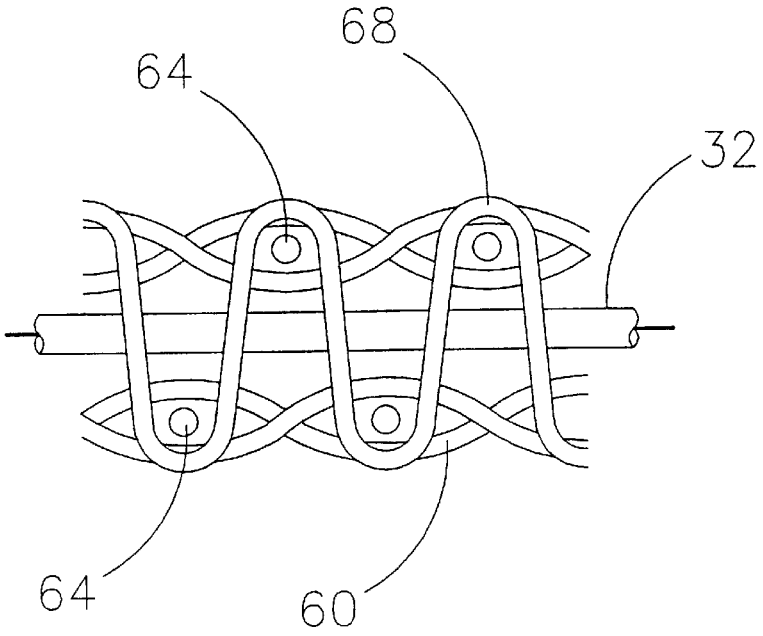
FIG. 2A is a sectional side view taken along line 2'—2' of FIG. 2.
Figure 2B:
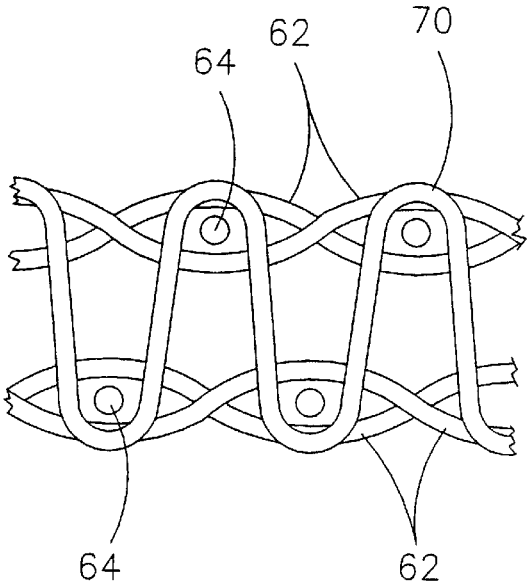
FIG. 2B is a sectional side view taken along line 2"—2" of FIG. 2.

Trunk section 12 at break out 22 is formed to have four cells 36, 38, 40, and 42 which are better shown in FIG. 2. A plurality of insulated cables or wires are divided into four groups 28, 30, 32, and 34 with a group being arranged to extend through each of cells 36, 38 40, and 42. It should be noted at this point that the number of insulated cables, while being uniformly shown as three, could vary between groups as also could the size of the cables within and between the groups.

Cells 36, 38, 40, and 42 extend a selected distance along trunk 12, in the instance of FIG. 1, about two-thirds of its length until they reach break point 44. Here again, the length of these cells relative to the trunk length can vary depending on the demands of the use area.

Figure 3:
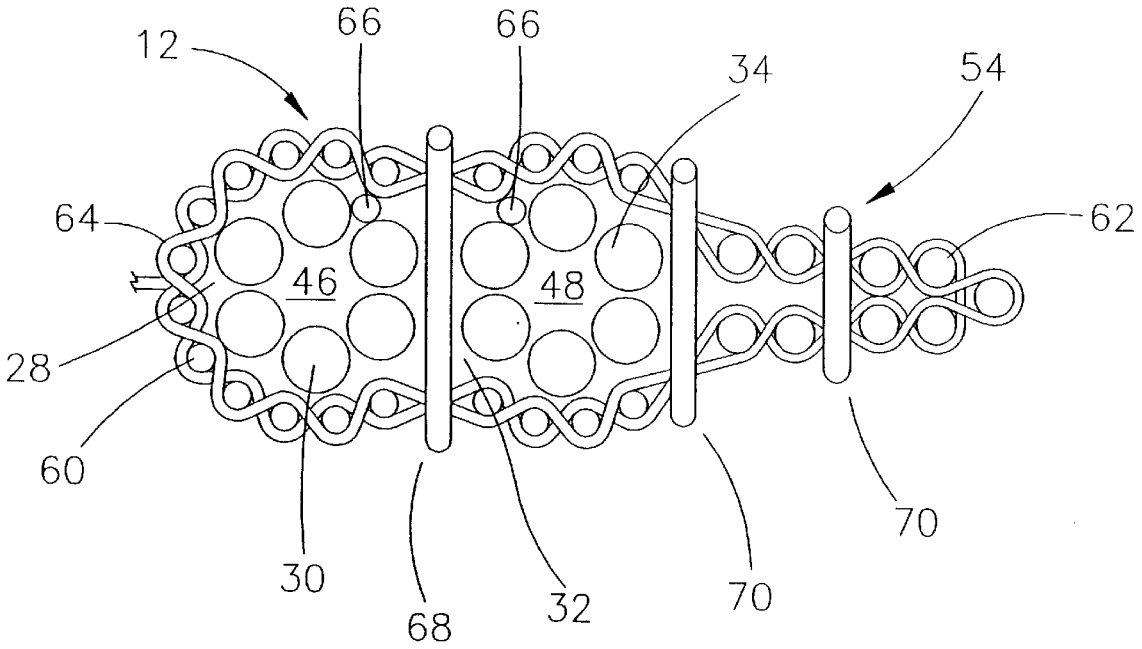
FIG. 3 is a sectional end view taken along line B—B of FIG. 1.

At break point 44, and as best seen in FIG. 3, cells 36, 38 merge to form a single cell 46 and cells 40, 42 merge to form a single cell 48. Insulated groups of wires 28, 30 consolidate as they pass from form cells 36, 38 into cell 46 and insulated wires 32, 34 consolidate as they pass from cells 40, 42 into cell 48.

Figure 5:
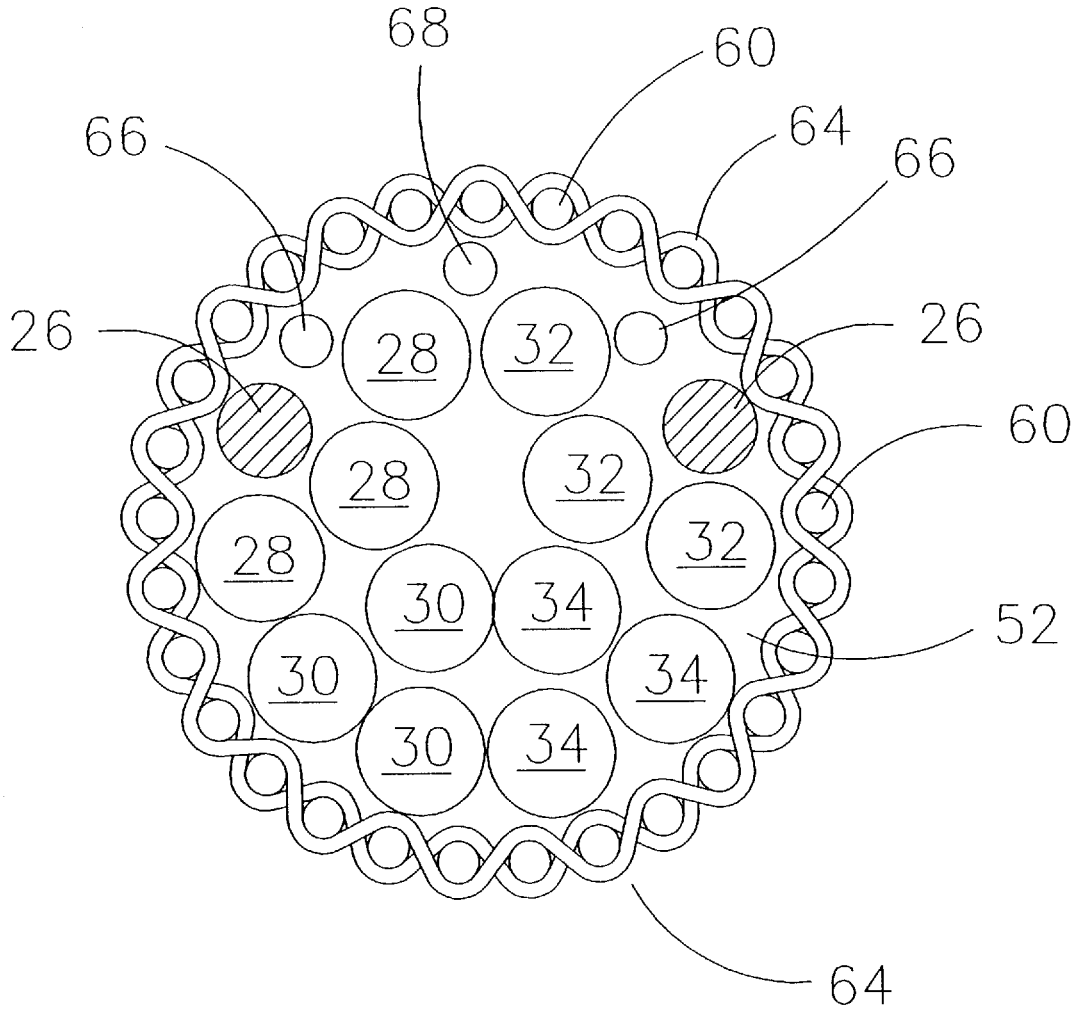
FIG. 5 is a section end view taken along line D—D of FIG. 1.

Trunk 12 continues from break point 44 in flat woven form comprising only cells 46, 48 to break point 16. As best seen in FIG. 5, at break point 16, trunk 12 merges into tube 14 and cells 46, 48 merge to form cell 52. Here the consolidated groups of wires 28, 30, and 34 again consolidate with all wires now passing through cell 52.

At break point 16, stuffer warps are inserted into cell 52. As seen in FIGS. 1 and 5, insulated wires 28, 30, 32, and 34 along with stuffer warps 26 are encased in cell 52 and pass through the cell and out break out 18. Stuffer warps 26 are enlarged to fill cell 52 so that a snug or tight fit for the insulated wires is created so that they are maintained in a substantially fixed position as they pass through tube 14.

It can be seen in FIGS. 1, 2, and 3 that there is, along the right edge of trunk 12, a flat woven edge portion which is identified as selvage 54. Selvage 54 is formed integral with tab 24 and continues past break out 22 along one side of and integral with trunk 12 up to break out 16 where tube section 14 begins. At this point selvage 54 separates from the longitudinal portion of the harness and is formed as midpoint tab 56. It is noted that, if desired, an additional selvage could be woven along the opposite edge of trunk 12 in mirror image of the shown selvage 54.

As earlier stated, the harness assembly of the invention is intended of use in confined, tortuous areas of varying sizes which occur along inner walls of air plane fuselages and in missiles. It is therefore intended that trunk section 12 and tube section 14 are capable of variable length as demanded by the particular housing in which they are encased. Also, the length of any section between break out and break point or break point and break point can vary as conditions dictate.

Tab elements 20, 24, and 56 are utilized to receive snap elements or to simply function as ties to secure harness assembly 10 in position within the housing assembly.

Turning now to FIGS. 1–5, the manner in which cable assembly 10 is woven is now detailed. FIG. 2 is an end view in which first warp yarns 60 are shown as arranged in a substantially stacked manner. First warp yarns 60 extend the entire length of harness assembly 10 as shown in FIG. 1. Arranged adjacent to and parallel with first warp yarns 60 are second warp yarns 62. Warp yarns 62 extend only through tab 24, selvage 54 and tab 56 of harness assembly 10 also as shown in FIG. 1. Arranged with first and second warp yarns 60, 62 are spaced binder yarns 66, 68, 70 with binder yarns 66, 68 weaving with first warp yarns 60 and binder yarns 70 weaving with second warp yarns 62.

A single weft yarn 64 weaves with both groups of warp yarns 60, 62 and with binder yarns 66, 68, and 70 in a basic four pick repeating pattern.

Again referring to FIG. 2, first and second warp yarns 60, 62 are generally along above and below line X—X. During weaving, weft yarn 64 moves first from the left to the right passing over and then under successive upper warp yarns 60, 62. On its return, from right to left, weft yarn 64 moves over and then under lower warp yarns 60, 62. Another traverse through the upper and lower warp yarns passing over and under in the opposite manner of the first two traverses completes the weave pattern. It can be seen that binder yarns 66, 68, and 70 always pass over the weft yarn passes, the binder yarns serving to draw the upper and lower warp yarn layers toward each other and defining the cells 56, 58, 40, 42 through which is insulated wire groups 28, 30, 32, and 34 pass. It will be noted that harness assembly 10 throughout that portion shown along lines A—A is a substantially flat cable assembly.

Moving now past break point 44 and that portion of the harness assembly shown in the direction of lines B—B of FIG. 1 and in detail in FIG. 3. Harness assembly 10 in this area is reconfigured to be slightly thicker and slightly less wide by combining cells 36, 38 into single cell 46 and cells 40, 42 into single cell 48. This is performed by simply controlling binder yarns 66 to pass beneath the successive traverses of weft yarn 64 which causes them to float in the cells 46, 48 along with the insulated wire groups 28, 30, 32, and 34. FIG. 3 clearly shows that in this area trunk 12 to include selvage 54 and still consist of all of the warp yarns of the first and second warp groups 60, 62 interweaving with weft yarn 64.

Figure 4:
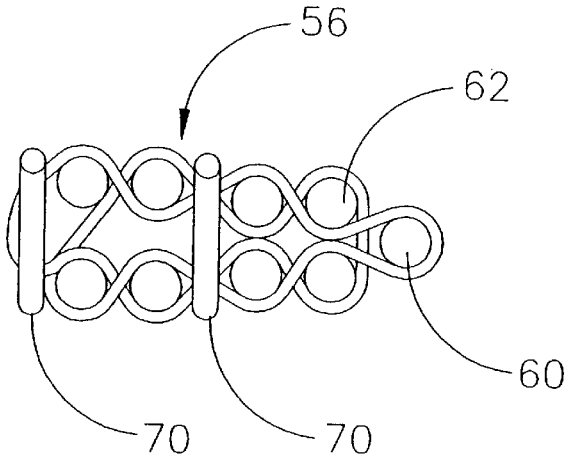
FIG. 4 is a sectional end view taken along line C—C of FIG. 1.

Moving now to break point 16, best shown in FIGS. 1, 4, and 5. At this point, harness assembly 10 is converted to be formed of a tube portion 14 having a single cell 52. This is accomplished by causing cells 46, 48 to merge together at break point 16 to form the single large cell. FIG. 5 shows warp yarns 60 of the first group of warp yarns still weaving with weft yarn 64 while binder yarns 66, 68 all pass beneath the weft yarn to form the single cell. All of the insulated wire yarns of groups 28, 30, 32, and 34 now are allowed come together to pass through the single cell 52 along with binder yarns 66, 68.

Because of the number of wires in cell 52, it has been found to be desirable to stabilize them to be maintained stationary relative to each other. This is accomplished by providing at least two large stuffer yarns 26 which pass beneath first warp yarns 60 and weft 64 and within cell 52.

In the area of tube 14, weft yarn 64 first weaves with first warp yarns 60 to form cell 52 and then in a separate motion weaves with second warp yarns 62 to form tab 56 as shown in FIGS. 1 and 4. Tab 56 also includes binder yarns 70 which continue to weave with weft 64 to maintain the structure flat.

Tube 14 continues until breakout 18 is reached. At this point stuffer yarns 26 along with insulated wire groups 28, 30, 32, 34 are brought out of the weave. The binders are cut away and the insulated wires are exposed to be united with connectors.

Tab 20, which is formed by weft 64 weaving with first warp group 60 and binders 66, 68 continues past breakout 18.

Figure 6:
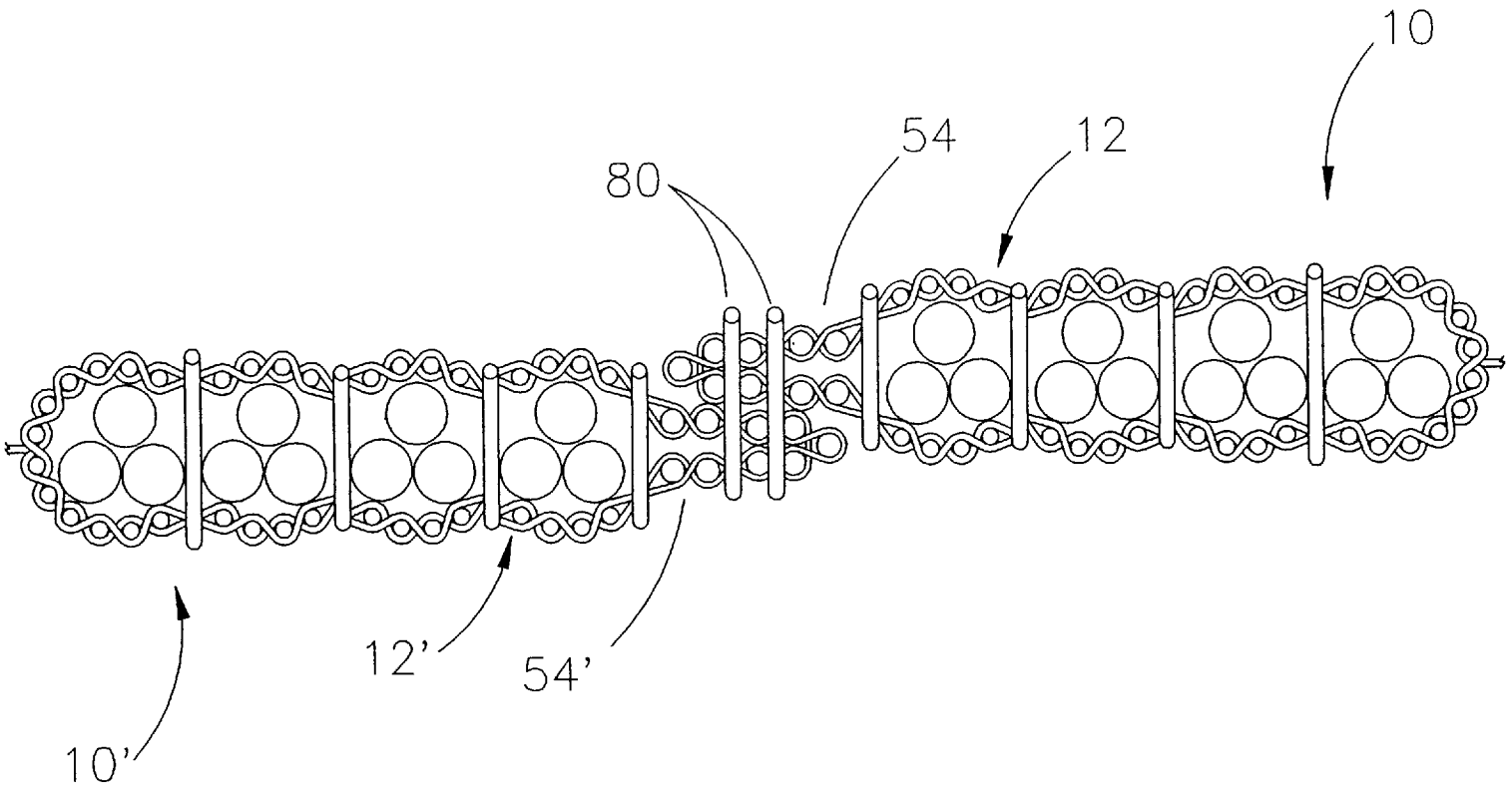
FIGS. 6 and 7 are sectional side views similar to FIGS. 2 and 3 showing two cable assemblies united into a single large assembly.
Figure 7:
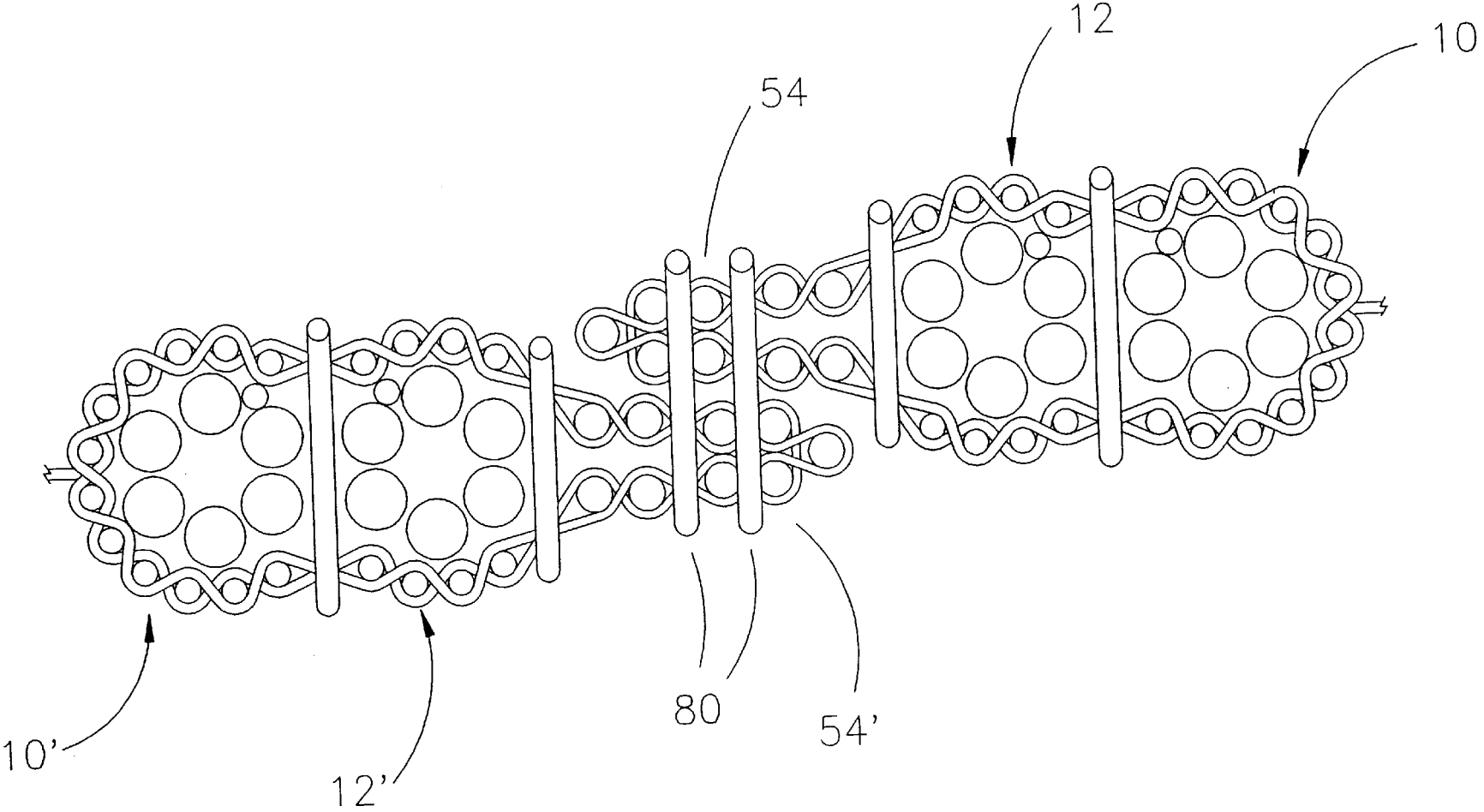
Figure 8:
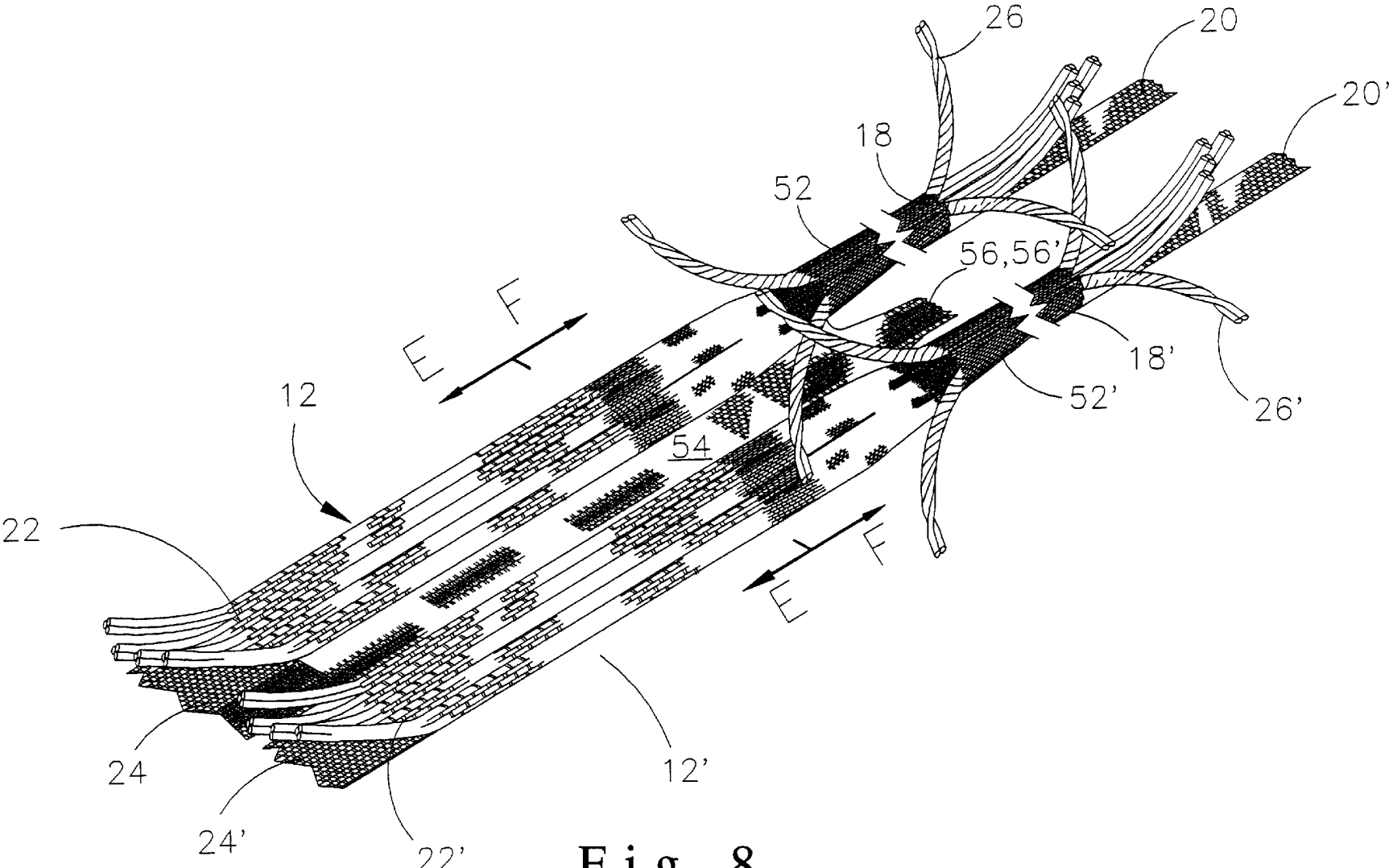
FIG. 8 is a perspective view of the interconnected harness assembly similar to FIG. 1.

The system may comprise more than one harness assembly. FIGS. 6 and 7 show two identical harness assemblies 10, 10'united together along their trunk portions 12, 12' by stitching 80 which passes through selvages 54, 54'. As shown in FIG. 8, the combined harness assemblies 10, 10' are separated around tube portions 14, 14'. This arrangement allows this portion of the assembly to pass on opposite sides of a divider or along separated spaced passageways.

It is preferred that the warp yarns, the binder yarns, the stuffer yarns, and the weft yarns be formed of VECTRAN, a multi-filament high performance thermoplastic liquid crystal polymer yarn (LCP) produced by Hoechst Celanese Vectra. VECTRAN possesses good temperature insulating properties and has good abrasion resistance. It is not necessary however that all of or for that matter, any of the above yarn systems be formed with yarns of VECTRAN. Any synthetic yarn possessing, satisfactory heat insulating and abrasion resistant properties could be used.

The size of the various yarns is also a matter utility dictated by the use area. It is essential that the harness assembly be woven sufficiently dense to produce cover of at least 90% for the insulated conductor wires and preferably sufficient to provide 100% cover. Cover of 100% is an accepted textile term which conveys that the weave is sufficiently dense to not allow the insulated wires to be seen through the weave.

While the description of the construction of the cable has been limited to weaving, it is understood that other methods such as knitting or braiding may be utilized.

While a preferred embodiment of the invention has been described using specific terms, such description is for illustrative purposes only, and it is to be understood that changes and variations may be made without departing from the spirit or scope of the following claims.

What is claimed is:

1. An insulating fabricated wire harness assembly for use in restricted areas of varying sizes, which includes a fabricated cable carrying a plurality of insulated conductors having exposed first and second ends:

said cable being comprised of interengaged yarns forming a trunk portion comprising at least first and second sections and a tube portion, opposed ends of each of said portions terminating with a break out area, said at least first and second sections of said trunk portion having a plurality of cells with said second section of said trunk portion having a greater number of said cells than said first section and said tube portion having a single cell, said plurality of insulated conductors being arranged to extend through said cells and continuously along the length of said cable, with said first exposed ends extending outwardly from said break out area of said tube portion and said second exposed ends extending outwardly from said break out area of said trunk portion, said yarns forming said cable being disposed relative to each other to provide at least 90% cover whereby said cable provides mechanical and thermal insulation for said insulated conductors.

2. The harness assembly according to claim 1 wherein said first section comprises at least two of said plurality of cells and said second section having at least four of said plurality of cells.

3. The harness assembly of claim 2 wherein an end of said opposed ends of said tube portion merges with a first end of said first section forming a first break point where said at least two cells of said first section merge with said single cell of said tube portion.

4. The harness assembly of claim 3 wherein said insulated conductors extend continuously within each of said cells along the length of said cable.

5. The harness assembly of claim 3 wherein a second end of said first section merges with an end of said second section forming a second break point where said at least two cells of said first section merge with said at least four cells of said second section.

6. The harness assembly of claim 1 wherein said yarns comprise multifilaments of liquid crystal polymers.

7. The harness assembly of claim 1 wherein said interengaged yarns are arranged relative to each other to provide 100% cover for said insulated conductors.

8. The harness assembly of claim 1 wherein said yarns are comprised of liquid crystal polymers.

9. The harness assembly of claim 1 wherein said trunk portion comprises at least a pair of trunk portions and said tube portion comprises at least a pair of tube portions.

10. A woven wire harness assembly for use in restricted areas of varying sizes, which includes a fabricated cable carrying a plurality of insulated conductors having exposed ends:

said cable being comprised of a first plurality of warp yarns, a plurality of binder warp yarns woven with weft yarns to form a trunk portion and a tube portion, each terminating with a break out area, said trunk portion having first and second sections each having a plurality of cells and said tube portion having a single cell, each of said of binder warp yarns, weaving with said weft yarns in said second section to form said plurality of cells and only selected ones of said plurality of binder warp yarns weaving with said weft yarns in said first section to form said plurality of cells, said plurality of insulated conductors being arranged to extend continuously along the length of said cable, said insulated conductors extending through said cells with said exposed ends extending outwardly from said break out areas, said cable being woven at a density sufficient to provide thermal and abrasion protection for said insulated conductors.

11. The harness assembly according to claim 10 wherein said first section comprises at least two cells of said plurality of cells and said second section comprises at least twice the number of cells as said first section, a first end of said first section forming a first break point where said at least two cells merge with said single cell of said tube portion.

12. The harness assembly of claim 10 including stuffer warps extending through said single cell of said tube portion along with said insulated conductors, said stuffer warps packing said insulated conductors in a stationary position within said single cell.

13. The harness assembly of claim 10 including a second plurality of warp yarns, said second plurality of warp yarns weaving with said weft yarns to form a selvage along at least a portion of at least one side of said cable.

14. The harness assembly of claim 13 wherein said selvage extends along and is integral with said trunk portion.

15. The harness assembly of claim 13 wherein said selvage extends along a portion of said tube portion without being connected therewith, said selvage forming an elongated tab.

16. The harness assembly of claim 10 including first and second tabs, said first and second tabs being connected with and extending from opposite ends of said cable at said break out areas, at least one of said first and second tabs being formed by weaving said first plurality of warp yarns with said weft yarns.

17. The harness assembly of claim 10 wherein said warp and weft yarns comprise thermoplastic multi-filament yarns of liquid crystal polymer.

18. The harness assembly of claim 10 wherein said binder warp yarns extend through said single cell of said tube portion along with said insulated conductors.

19. A woven wire harness assembly constructed for use in confined areas of variable size, said assembly comprising:

first and second woven cables each having a trunk portion having a plurality of cells arranged in decreasing order along its length and a tube portion having a single cell connected at one end with one end of said trunk portion so that said cells of said trunk portion merge with said single cell of said tube portion;

a plurality of insulated conductors extending along the length of said cables, said insulated conductors passing through said cells;

a selvage woven with each of said trunk portions to extend along an edge thereof;

said first and second cables being stacked one upon the other with said selvage of said first cable being arranged over said selvage of said second cable; and, a connector passing through said selvages interconnecting said first cable with said second cable along at least portions of their length forming said woven harness assembly.

20. The harness assembly of claim 19 including a break out formed at opposite ends of said harness assembly, said break outs including tabs for connecting said harness assembly to support structure and openings allowing the opposed ends of said conductors to extend beyond said cables for connecting with connectors.

21. The harness assembly of claim 19 including a tab formed adjacent said connection between said tube portion and said trunk portion of each of said cables of said harness assembly.

22. The harness assembly of claim 19 wherein each of said cells carries a plurality of insulated conductors of said plurality of insulated conductors.

23. The harness assembly of claim 19 wherein certain of said plurality of insulated conductors of said plurality of insulated conductors and and certain other of said cells carry a single insulated conductor of said plurality of insulated conductors.

24. The harness assembly of claim 19 wherein including warp stuffers, said warp stuffers extending through said single cell of said tube portion along with said plurality of insulated conductors, said warp stuffers acting to maintain said insulated conductors into a stationary position.

* * * * *